US009390873B2

(12) United States Patent
Thomas

(10) Patent No.: US 9,390,873 B2
(45) Date of Patent: Jul. 12, 2016

(54) GREEN SWITCHGEAR APPARATUSES, METHODS AND SYSTEMS

(71) Applicant: Schneider Electric Industries SAS, Rueil-Malmaison (FR)

(72) Inventor: Rajesh Thomas, Capalaba (AU)

(73) Assignee: Schneider Electric Industries SAS, Rueil-Malmaison (FR)

( * ) Notice: Subject to any disclaimer, the term of this patent is extended or adjusted under 35 U.S.C. 154(b) by 4 days.

(21) Appl. No.: 14/340,472

(22) Filed: Jul. 24, 2014

(65) Prior Publication Data

US 2015/0027988 A1 Jan. 29, 2015

Related U.S. Application Data

(60) Provisional application No. 61/857,926, filed on Jul. 24, 2013, provisional application No. 62/027,169, filed on Jul. 21, 2014.

(51) Int. Cl.
*H01H 33/664* (2006.01)
*H01H 33/12* (2006.01)

(52) U.S. Cl.
CPC ..... *H01H 33/664* (2013.01); *H01H 33/122* (2013.01); *H01H 2033/6648* (2013.01)

(58) Field of Classification Search
CPC . H01H 33/53; H01H 33/56; H01H 2033/566; H01H 2033/6623; H01H 2033/66223; H01H 2033/6648; H01H 33/122
USPC ..... 218/117, 118, 134, 139, 155, 153, 154; 361/326, 605, 612
See application file for complete search history.

(56) References Cited

U.S. PATENT DOCUMENTS

| | | | | | |
|---|---|---|---|---|---|
| 3,735,019 | A * | 5/1973 | Hess | H01B 17/32 | 174/14 BH |
| 3,898,406 | A * | 8/1975 | Larkin | H01B 17/005 | 218/134 |
| 5,387,772 | A * | 2/1995 | Bestel | H01H 33/66207 | 218/118 |
| 5,808,258 | A * | 9/1998 | Luzzi | H01H 33/66207 | 218/136 |
| 5,917,167 | A * | 6/1999 | Bestel | B29C 63/18 | 218/138 |
| 7,473,863 | B2 * | 1/2009 | Schreiber | H01H 33/027 | 218/138 |
| 2010/0170774 | A1 * | 7/2010 | Einschenk | H01H 33/027 | 200/48 R |

* cited by examiner

*Primary Examiner* — Renee S Luebke
*Assistant Examiner* — William Bolton
(74) *Attorney, Agent, or Firm* — N. W. Poulsen

(57) ABSTRACT

This disclosure relates to switchgear equipment for electrical power systems. A switchgear comprises a switchgear body housing, having an upper boot and a lower boot, the upper boot having an insulating material and the lower boot having an insulating material, a vacuum interrupter having at least one stationary electrical contact, a moveable contactor coupled to a moveable electrical contact, and at least two bushings having conductor material passing therethrough, the switchgear further comprising at least one of a bushing boot having at least one of a helical groove and an array of heat-removal fins, a flexible, insulating cover enclosing at least a portion of the vacuum interrupter and an adjacent bushing, a helical groove in the upper boot, and a finned connector constrained within a channel in the moveable contactor.

18 Claims, 19 Drawing Sheets

GREEN SWITCHGEAR APPARATUSES, METHODS AND SYSTEMS

This application claims the benefit of U.S. Provisional Application No. 61/857,926, filed Jul. 24, 2013, and of U.S. Provisional Application No. 62/027,169, filed Jul. 21, 2014. The entire contents of the aforementioned applications are herein expressly incorporated by reference.

This application also cross-references Australian Patent Application No. 2014206176, filed Jul. 24, 2014, the entire contents of which is herein expressly incorporated by reference.

This application for letters patent disclosure document describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

FIELD

This disclosure is related to aspects of electric power delivery systems including, but not limited to, switchgear technology, and more particularly, GREEN SWITCHGEAR Apparatuses, Methods and Systems.

BACKGROUND

In electric power generation and distribution, switches, fuses, and circuit breakers are used to control power and protect connected equipment.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the GREEN SWITCHGEAR Apparatuses, Methods and Systems ("GREEN SWITCHGEAR") will now be described, by way of illustrative example only, with reference to the accompanying drawings, in which.

DETAILED DESCRIPTION

Figure 1A:
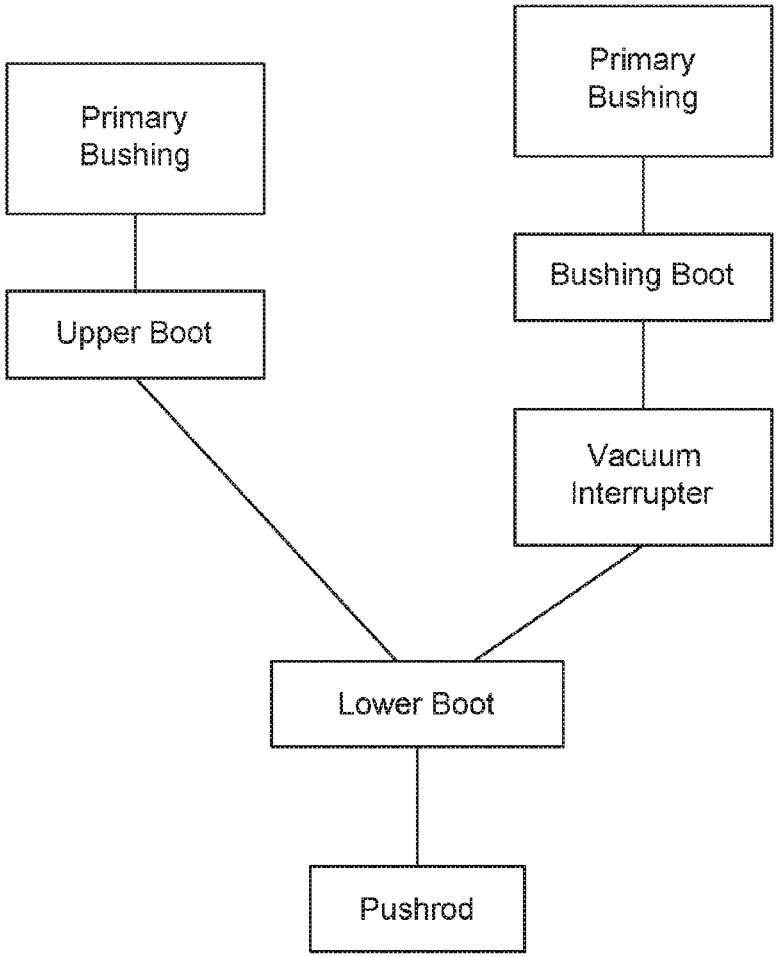
FIG. 1A is a block diagram of an example embodiment of the GREEN SWITCHGEAR.

As disclosed herein, embodiments of the GREEN SWITCHGEAR Apparatuses, Methods and Systems ("GREEN SWITCHGEAR") provide innovative new advances in electric power distribution and management.

Sulfur hexafluoride ($SF_6$) is a chemically stable, electrically insulating gas used in high voltage switchgear equipment in electric power systems. $SF_6$ is also a greenhouse gas, and may produce lethal byproducts when subjected to arcing or corona discharge. Embodiments of the disclosed GREEN SWITCHGEAR provide innovative $SF_6$ replacement architecture, voltage sealing and heat transfer. Additional and/or alternative embodiments of the GREEN SWITCHGEAR provide for innovative voltage sealing and/or heat transfer.

As used herein, switchgear can include switches, fuses, circuit breakers, substations, fault isolation equipment, arc prevention equipment, other types of electrical isolation equipment, combinations thereof, and/or the like, and can be employed for low, medium, and/or high-voltage applications. Switchgear can be insulated using oil, vacuum, and/or gases, and/or the like. In some switchgear configurations, degraded performance, in some instances due to partial discharge, can occur, for example due to trapped air introduced by the placement of flexible insulators close to a voltage source, and/or the presence of sharp points, "burrs" or other asperities that can act as field concentration points, leading to electrical shorting and degraded performance. Also, industrial production and/or usage of switchgear insulated with sulfur hexafluoride (hereinafter "$SF_6$") can potentially lead to the release of $SF_6$ gas, a potent greenhouse gas, into the environment. Switchgear can be "voltage sealed" to insulate the primary current carrying path from earth potential for power-frequency and lightning impulse voltages. This is done by incorporating electrically-insulating elements (e.g., "basic insulation level," hereinafter "BIL"), which keep the high voltage insulated from earth. In some applications, voltage sealing in switchgear devices is accomplished either by employing insulators that are dimensioned such that the creepage distance is sufficient to withstand an applied voltage, or by employing a large diaphragm to seal the pushrod/epoxy body junction, the seal often having multiple types of insulating material, the majority of which is generally non-flexible epoxy. Creepage distance is defined as the shortest distance between two conductive parts—e.g., between two parts having different voltage values, or between a part having a high potential and a part at earth potential—as measured along the surface of what lies between them, e.g. one or more insulators. These methods of voltage sealing generally pertain to designs using a large clearance between conductive parts (i.e., creepage). Known air-insulated switchgear equipments, for example, are typically designed to have larger dimensions, due to BIL specifications and thermal management concerns (e.g., convection and the free movement of air/gas).

Some embodiments of the disclosure provide for the fabrication of switchgear equipment without the use of sulfur hexafluoride (hereinafter "$SF_6$") and/or switchgear equipment that does not include $SF_6$, via innovative designs incorporating dielectric materials such as silicone rubber and air. Depending on the embodiment, the GREEN SWITCHGEAR, according to the disclosure, may contain no $SF_6$, may be essentially free from $SF_6$, may be substantially free from $SF_6$, or may use less $SF_6$ than is typically used in known switchgear technology. Switchgear produced according to aspects of the present disclosure may be free from partial discharge, display desirable "withstand voltage" (i.e., dielectric breakdown voltage) and BIL levels, and satisfy industrial heat rise specifications without compromising the short-circuit performance. For example, in one embodiment described below with reference to the drawings, an elastic cover may be used to provide a "voltage seal" around a bushing (e.g., an epoxy resin-cast bushing, a porcelain bushing(s), and/or the like). The bushing is coupled to a vacuum interrupter, and the elastic cover insulates the conductor and avoids the negative impact of partial discharge caused by the application of silicone rubber or the presence of flexible insulators on or along the primary current carrying path. The use of a flexible insulating barrier may, in some contemplated embodiments, be used to cover the entirety of the current carrying part, for example enabling voltage sealing without causing partial discharge. In one embodiment, silicone rubber may be used to cover all current-carrying components of the switchgear.

Some embodiments of the GREEN SWITCHGEAR result in a reduction of overall switchgear size of at least 50%, as compared with known switchgear. In other words, the technology described by this disclosure allow for a reduction in size of switchgear, as compared with known switchgear, while retaining the same level of performance regarding one or more performance metrics (such as power rating, power consumption, arc withstand voltage, thermal management capability, etc.). For example, known air-insulated switchgear can have a width of 1200 mm, while switchgear according to the disclosed GREEN SWITCHGEAR can have a width of 600 mm or less. Depending on the embodiment, switchgear according to the disclosure may permit a reduction in overall switchgear size, as compared with known switchgear, of up to approximately 20%, up to approximately 25%, up to approximately 30%, up to approximately 40%, up to approximately 50%, between approximately 45% and approximately 55%, up to approximately 60%, up to approximately 70%, or up to approximately 80%. In some embodiments, switchgear according to the disclosure may permit a reduction in overall switchgear size of at least approximately 50%, at least approximately 65%, at least approximately 75%, or at least approximately 80%. Some embodiments of the GREEN SWITCHGEAR have a 50% smaller footprint for the same voltage rating, when compared with the footprint and voltage rating of a known switchgear, with minimum or no reduction in creepage distance required in air. Some embodiments of the GREEN SWITCHGEAR are $SF_6$-free and partial-discharge free, with similar temperature rise performance during maximum normal current when compared with known switchgear. Some embodiments of the GREEN SWITCHGEAR provide an improvement in temperature rise performance or "heat rise" performance when compared with known switchgear. For example, in some embodiments, a switchgear according to the disclosure exhibit an approximately 5° C., approximately 10° C., approximately 15° C. or approximately 20° C. improvement in temperature rise performance. Temperature rise performance may refer to the ability of the switchgear to sustain a specific level of performance at a higher temperature than a conventional switchgear would be capable of doing. Temperature rise performance may be described, for example, through a series of performance graphs (e.g., relating to power rating, voltage setting, load frequency, and/or other electrical parameter or performance measurement, and/or the like) each corresponding to a different ambient temperature condition (e.g., as ambient temperature increases, performance may degrade in one or more measurable ways).

Some embodiments of the GREEN SWITCHGEAR are $SF_6$-free and partial-discharge free, with similar temperature rise performance during maximum normal current when compared with known switchgear. Some embodiments of the GREEN SWITCHGEAR have a 10° C. improvement in temperature rise performance when compared with known air-insulated switchgear.

According to some embodiments of the GREEN SWITCHGEAR, a conductive coating is applied to surface(s) of at least one silicone rubber part which will then abut at least one "primary component" (e.g., a vacuum-interrupter and/or the like, typically of metal composition). This conductive coating can advantageously be applied such that the morphology of the coating surface, either by virtue of the paint itself or by virtue of the paint in combination with the underlying structure to which it is applied, has a non-abrupt (e.g., rounded, gently sloping, etc.) contour and/or shape. Said contour and/or shape may, for example, be macroscopically free from sharp points or edges. In some embodiments, the conductive coating is topographically "dull," i.e., the presence of sharp points, sharp edges, and/or other asperities has been reduced, minimized or eliminated. In an exemplary embodiment, a rounded conductive edge is provided at least along an end portion of the conductive coating that faces the lower potential (e.g., earth, ground, 0 volts, "reference potential," etc.). In a further embodiment, a rounded conductive edge is provided at least along two end portions of the conductive coating, one that is closest to the high voltage supply and one that is closest to the ground potential. The conductivity of the paint, shape of the painted profile, and/or location of the painted area can be configured to avoid partial discharge caused by trapped air at the mating surfaces on primary current carrying components, while the curved ends of the paint reduce unwanted partial electrical discharge caused by field concentration at sharp points and edges. In other contemplated embodiments, instead of or in addition to conductive paint, the silicone rubber (or other insulating material) elements of the GREEN SWITCHGEAR may comprise a conductive material (e.g., conductive powders, shavings, parts, etc.) embedded or otherwise incorporated therein.

Some embodiments of the disclosure relate to the interface between a switchgear body and a moving contactor part such as a pushrod. The moving contactor may be made at least partially of a suitable material such as polybutylene terephthalate (PBT), and/or other thermoplastic, polymer, and/or polyester materials, and/or various combinations thereof, and/or the like. The moving contactor may, in some embodiments, traverse a wall of the switchgear via a lower boot. For example, a finned connector comprising a flexible insulator such as silicone rubber may be provided in the switchgear body such that the finned connector may be at least partially received in a channel defined between solid insulating barriers on a pushrod. In some embodiments, the connector may snap into place. The pushrod channel may define a gap between said insulating barriers, which in some embodiments protrude from the surface of the pushrod. The fins of the finned connector can be configured and/or dimensioned such that they are received sufficiently tightly between the pushrod barriers so that, for example, a reliable seal may be made and retained during actuation of the pushrod. Such an embodiment may be said to provide an "inter-phase seal." In some embodiments, the inter-phase seal is positioned between a high voltage portion of the switchgear and a zero-potential portion of the switchgear.

In some embodiments, helical grooves (defined herein as continuous grooves that multiply traverse the periphery of a component, regardless of that component's shape) may be provided in at least one switchgear component to allow movement of gas (e.g., air) between a flexible barrier and the switchgear chamber. It is to be understood that helical grooves according to some embodiments of the disclosure can be defined as a continuous groove or grooves that multiply traverse the periphery of a component, regardless of the overall shape of the component. In some embodiments, a helical groove (or grooves) may appear to be generally, topologically, and/or substantially coiled, wound, corkscrew, spiral, screw shaped, radially-circling, helicoid, circumvoluted, and/or the like, based on the structure of the component. These helical grooves can be configured to improve voltage sealing by providing sufficient creepage distance to prevent flashover and/or voltage breakdown, and may also allow for the "breathing" (e.g., pressure release, removal of air/vacuum pockets, etc.) of confined areas such as the switchgear body, in addition to providing a path for thermal transfer between, for example, a switchgear chamber and a flexible insulating barrier and/or silicone rubber component and/or the like.

Further embodiments of the GREEN SWITCHGEAR incorporate silicone rubber (and/or like material) parts bearing multiple heat transfer fins, capable of transferring heat, for example by convection, radiation and/or conduction. In some such embodiments, the fins may be provided on a bushing boot that may further include helical grooves. A bushing boot, as described in greater detail below, may in some embodiments couple to a corresponding bushing and further function as a feedthrough, e.g., having a coaxial path through which a conductor may be inserted and/or serve as a "conduit."

Figure 1B:
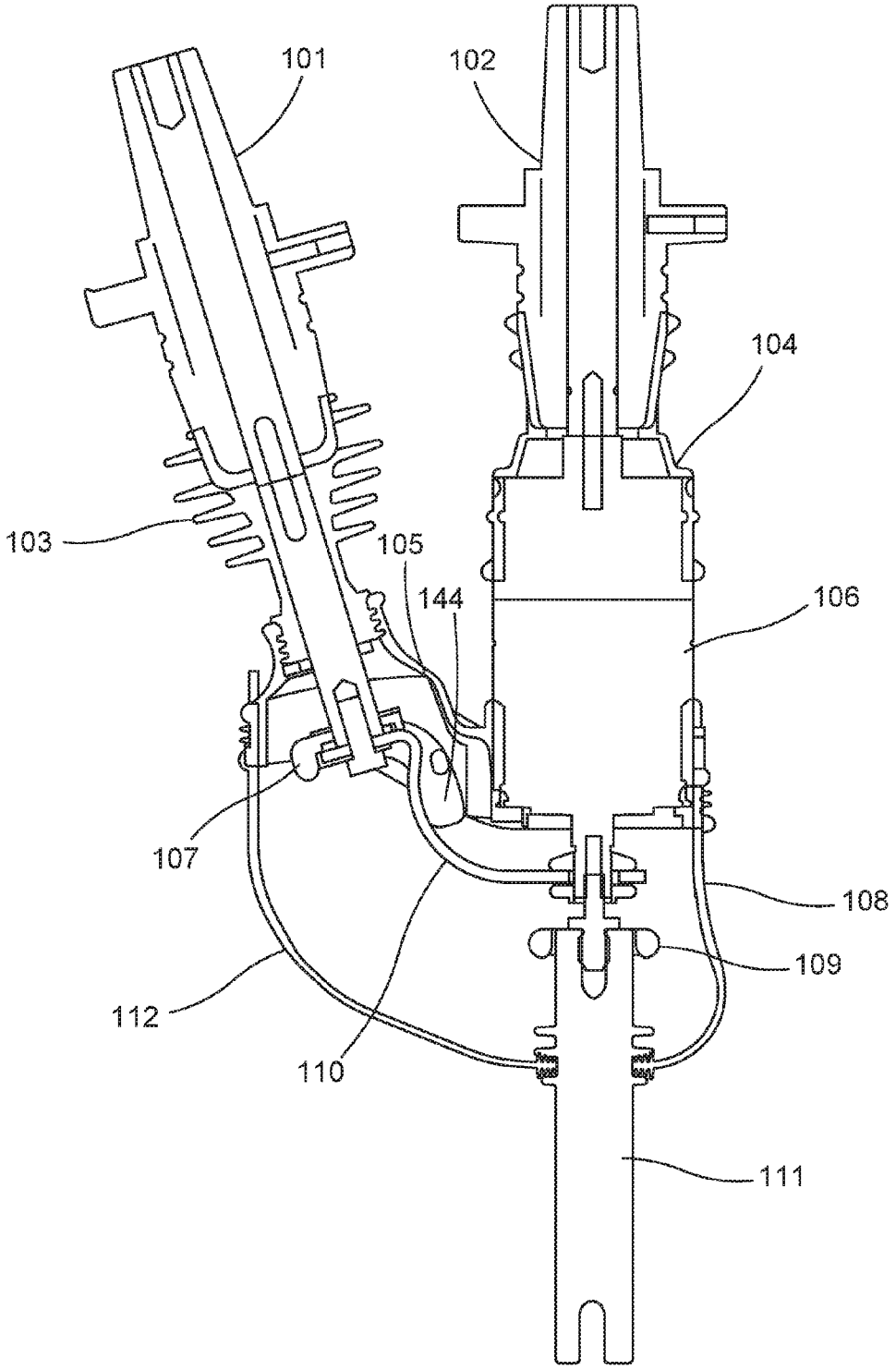
FIG. 1B is a cross-sectional view of an example embodiment of the GREEN SWITCHGEAR.

FIG. 1A is a system block diagram of a switchgear device according to the disclosed GREEN SWITCHGEAR. FIG. 1B shows a cross-sectional view of a switchgear device according to an implementation of some embodiments of the GREEN SWITCHGEAR, having a lower boot 108 comprising silicone rubber, an upper boot 105 also comprising silicone rubber (the upper and lower boots together forming a main switchgear body 112), a pushrod 111, a vacuum interrupter 106 coupled to a first primary bushing 102 by bushing boot 104 and received by the switchgear body via upper boot 105, a flexible guide 144, a flexible conductor 110, a flexible shroud 107, a pushrod shroud 109, and a second primary bushing 101 fitted to a finned silicone rubber bushing boot 103, the bushing boot 104 also received by the switchgear body via the upper boot. The vacuum interrupter 106 can be directly coupled or indirectly coupled (e.g., by way of an intervening component such as a spacer, connector, wire, conductor element, etc.) to the first primary bushing 102. Similarly, the vacuum interrupter 106 can be directly coupled or indirectly coupled (e.g., by way of an intervening component such as a spacer, connector, wire, conductor element, etc.) to the second primary bushing 101. In some embodiments, more than two primary bushings may be used. In some embodiments, when more than two primary bushings are used, the vacuum interrupter can be directly coupled to each of the primary bushings. In other embodiments involving more than two primary bushings, the vacuum interrupter is indirectly coupled to each one of the primary bushings. In still other embodiments involving more than two primary bushings, the vacuum interrupter can be directly coupled to one or more of the primary bushings, and indirectly coupled to one or more of the remaining primary bushings.

Figure 2:
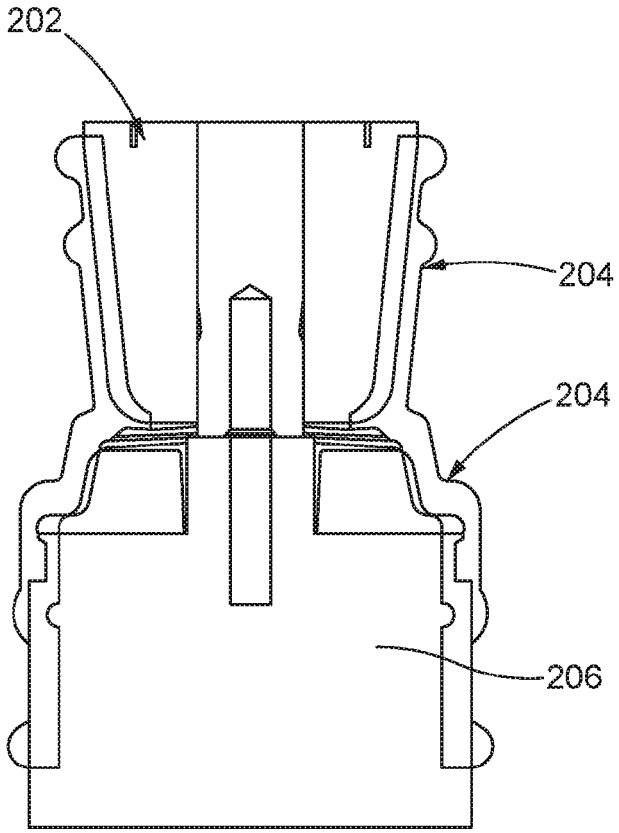
FIG. 2 is a partial, cross-sectional detail view of a primary bushing (with a flexible insulator installed) according to some embodiments of the GREEN SWITCHGEAR.

As illustrated in greater detail in FIG. 2, the interface between the vacuum interrupter 206 and a primary bushing 202 may be covered by or wrapped with an elastic insulating cover 204 comprising silicone rubber that extends partway along both the primary bushing 202 and the vacuum interrupter 206. The vacuum interrupter 206 can be directly coupled or indirectly coupled (e.g., by way of an intervening component such as a spacer, connector, wire, conductor element, etc.) to the primary bushing. Although several components of the GREEN SWITCHGEAR are described throughout this disclosure as comprising silicone rubber, it is to be understood that other suitable materials having suitable insulating, elasticity, flexibility and/or other relevant material properties may also be used, whether in combination with, or as a substitute for, silicone rubber, for example ethylene propylene diene monomer (EPDM) rubber, natural rubber, viton, nitrile butadiene rubber (NBR), and/or the like. In some embodiments, it may be desirable to employ silicone grease at one or more interfaces of the GREEN SWITCHGEAR, for example as a protectant and/or lubricant. In some embodiments, silicone grease is applied to one or more "like" interfaces (e.g., between silicone rubber and silicone rubber).

Figure 3:
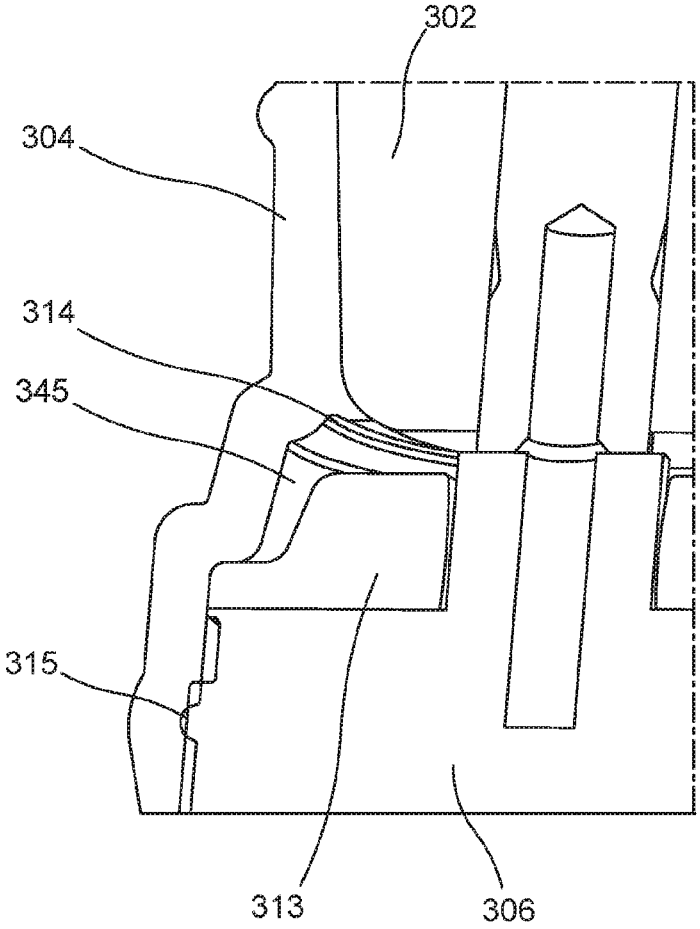
FIG. 3 is a further partial, cross-sectional detail view of a primary bushing according to some embodiments of the GREEN SWITCHGEAR.

FIG. 3 is a further detail cross-sectional view of a primary bushing according to some embodiments of the GREEN SWITCHGEAR, in which an aluminum spacer 313 is positioned between the vacuum interrupter 306 and its adjacent primary bushing 302. FIG. 3 also depicts the interface (e.g., extending from location 314 down to location 315) along which conductive paint (or other conductive coating) that has been applied to the interior of the silicone rubber cover 304 (in some embodiments referred to as a "bushing boot") contacts a circumferential portion of the aluminum spacer 313 (e.g., at 345) as well as a portion of the vacuum interrupter 306 and a portion of bushing 302. Conductive surfaces of the GREEN SWITCHGEAR can be advantageously shaped such that they do not contain any fine points or protruding edges (e.g., the surfaces are rounded or otherwise non-abrupt—see, e.g., the contour at 314). As discussed above, the shape of the conductive surfaces may result from the shape of the underlying structure (e.g., the silicone rubber cover), or may result of the application of the paint (e.g., applying the paint with sufficient thickness and with appropriate care so as to allow a rounded 'fillet' of paint to dry in locations where a sharp edge or protrusion would otherwise have been exposed and/or imparted to the finish). In some embodiments, the method of applying the conductive layer(s) determines the conductive layer(s)'s topography. For example, metal films deposited using vacuum deposition techniques (including but not limited to physical vapor deposition, chemical vapor deposition, thermal evaporation, sputtering, and/or the like) and/or metal plating techniques (e.g., electroplating and/or electroless plating) can result in desirable surface finishes having average roughness values lower than the roughness values realizable in machined metal parts. For example, a roughness value for metal surfaces of the switchgear, including the conductive coating, is less than 10 micrometers. In some embodiments, the average roughness of metal surfaces of the green switchgear is less than 5 micrometers. In some embodiments, the average roughness of metal surfaces of the green switchgear is less than 2 micrometers. In some embodiments, the average roughness of metal surfaces of the green switchgear is less than 1 micrometer. In some embodiments, the average roughness of metal surfaces of the green switchgear is on the order of nanometers (e.g., "nanoscale"). Since the termination of the conductive paint (or other coating) at 315 in FIG. 3 has a smooth (or "rounded") profile, there is a reduced propensity for voltage breakdown, as discussed above. In some embodiments, the conductive paint 345 may be applied only to a portion of the silicon rubber cover or bushing boot, for example such that it only contacts a portion of vacuum interrupter 306, or makes contact only with surfaces of the aluminum spacer 313, avoiding the vacuum interrupter 306 altogether.

Figure 4:
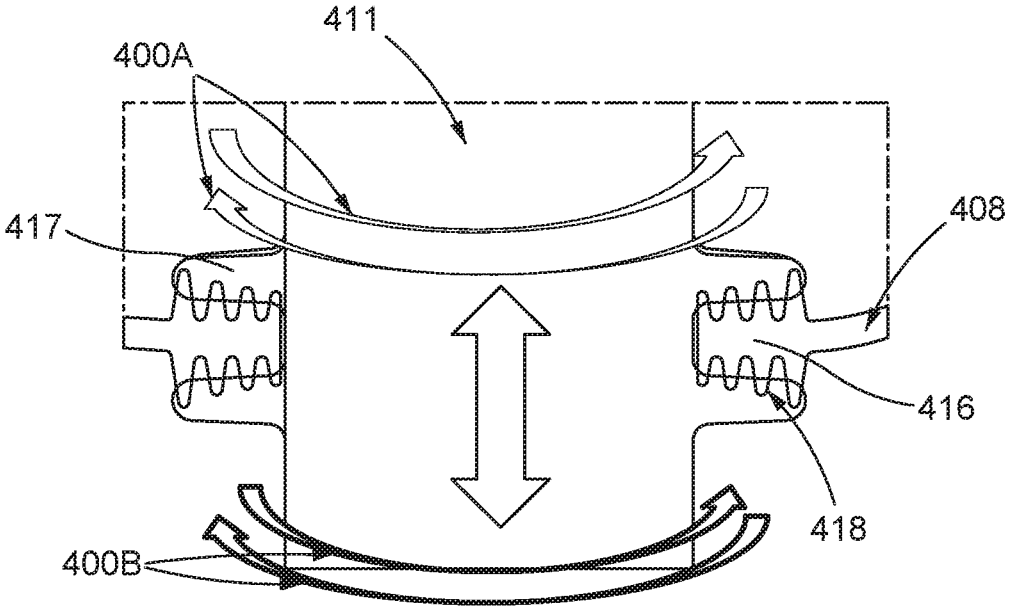
FIG. 4 is a cross-sectional detail view of a pushrod according to some embodiments of the GREEN SWITCHGEAR.
Figure 10B:
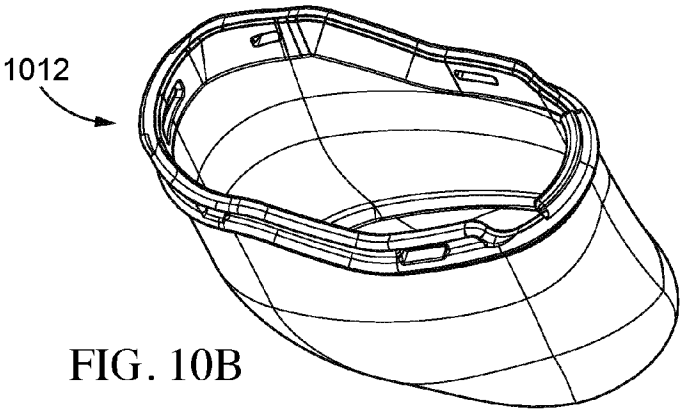
FIG. 10B is a perspective view of the lower boot of FIG. 10A.
Figure 10D:
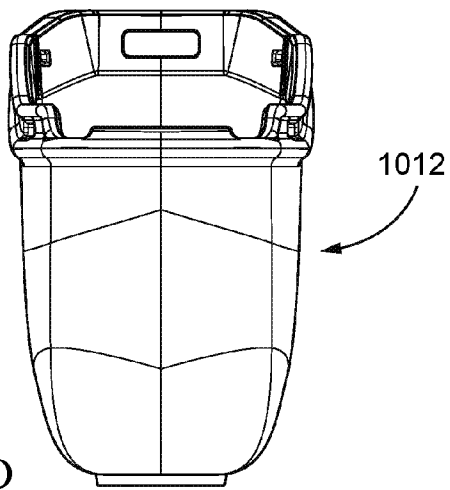
FIG. 10D is a rear view of the lower boot of FIG. 10A.
Figure 10A:
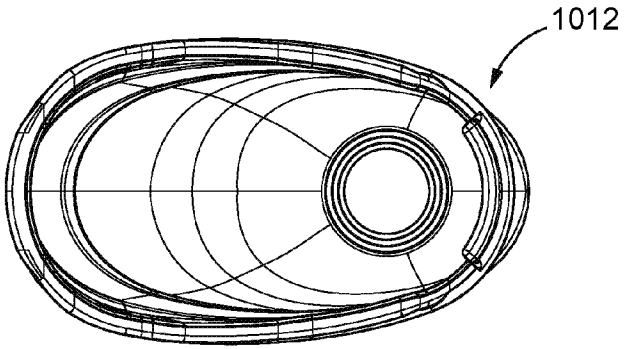
FIG. 10A is a schematic top view of a lower boot according to some embodiments of the GREEN SWITCHGEAR.
Figure 10C:
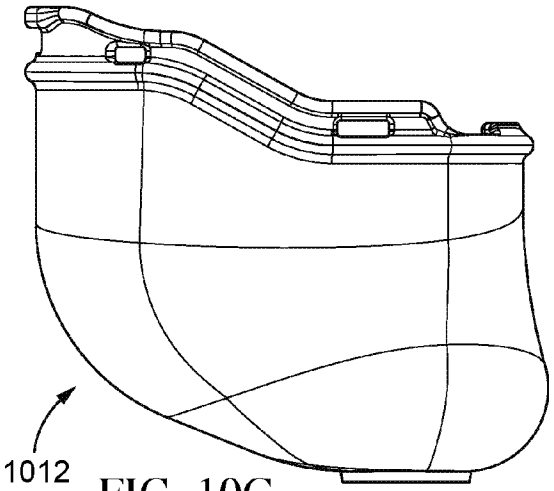
FIG. 10C is a left side view of the lower boot of FIG. 10A.
Figure 10F:
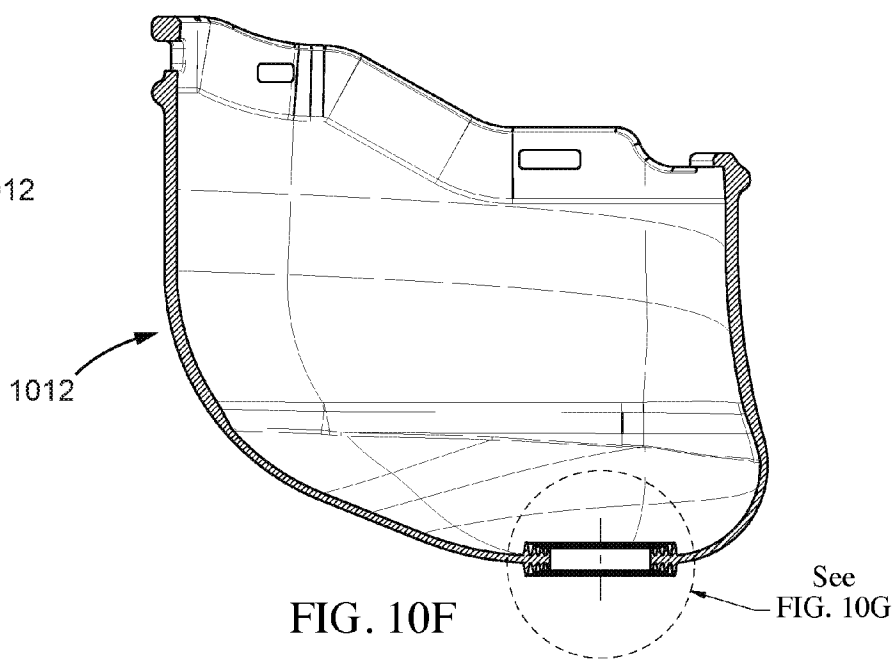
FIG. 10F is a left side cross-sectional view of the lower boot of FIG. 10A, including an illustration of the inter-phase sealing mechanism.
Figure 10E:
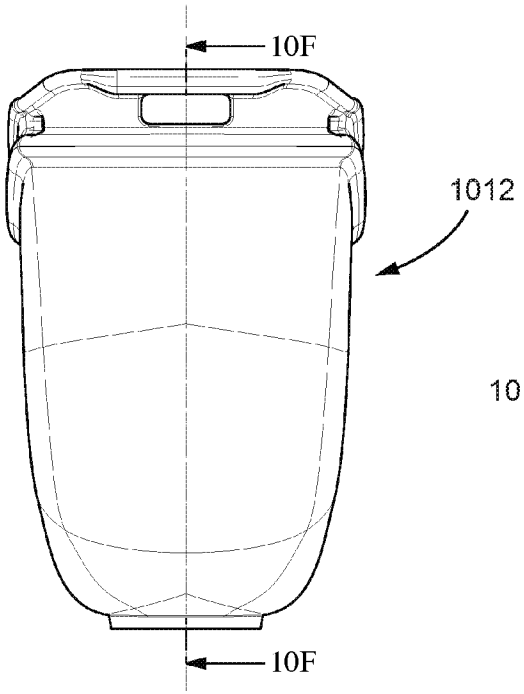
FIG. 10E is a front view of the lower boot of FIG. 10A.
Figure 10G:
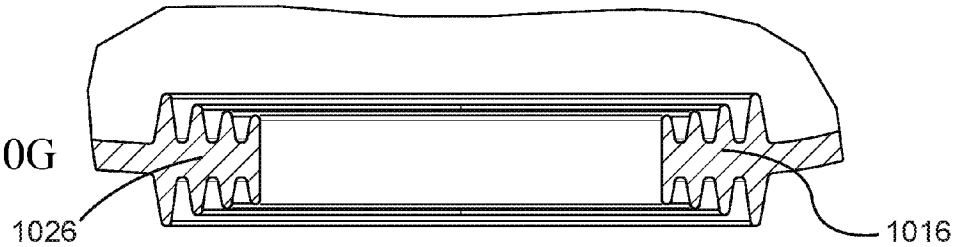
FIG. 10G is a detail view of the inter-phase sealing mechanism of the lower boot of FIG. 10A.
Figure 11B:
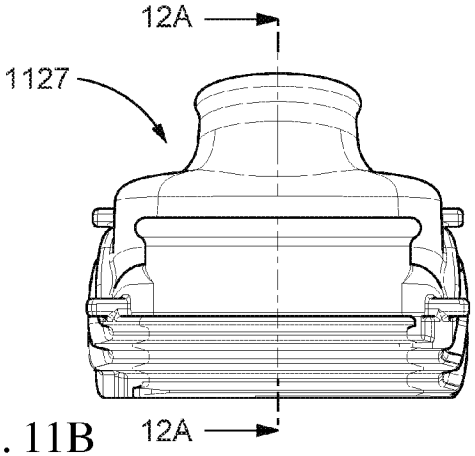
FIG. 11B is a rear view of the upper boot of FIG. 11A.
Figure 11C:
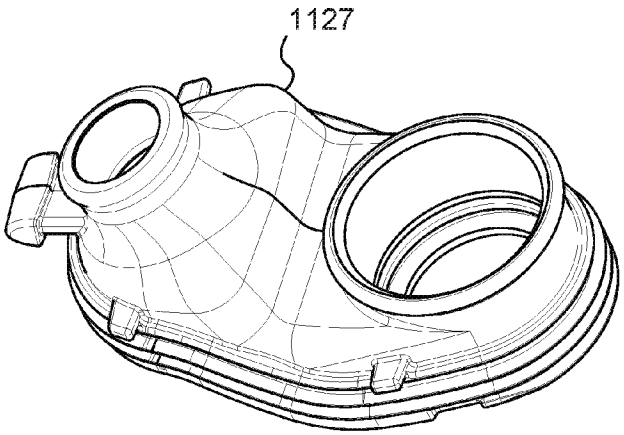
FIG. 11C is a top perspective view of the upper boot of FIG. 11A.
Figure 11A:
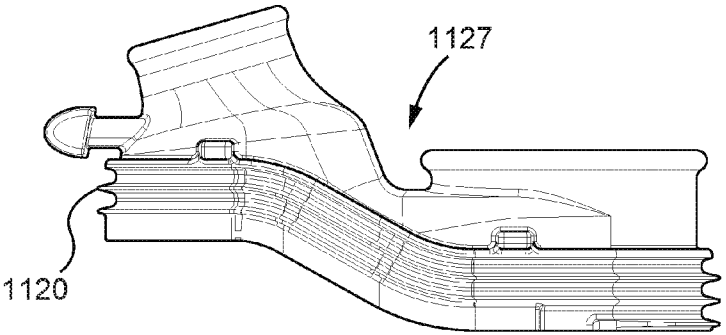
FIG. 11A is a left side view of an upper boot according to some embodiments of the GREEN SWITCHGEAR.
Figure 11D:
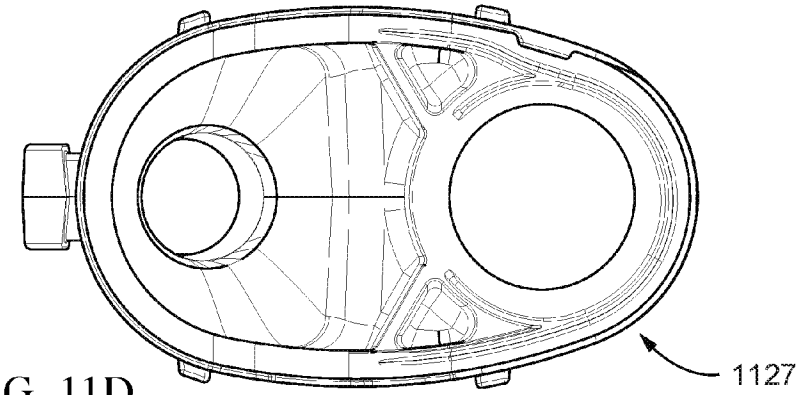
FIG. 11D is a top view of the upper boot of FIG. 11A.

FIG. 4 shows a partial, cross-sectional detail view of a pushrod 411 according to some embodiments of the GREEN SWITCHGEAR. The pushrod is or has a moveable contact that actuates, generally along its longer axis, during switching operation (e.g., the selective "opening" and "closing," or "energizing" and "de-energizing" of a circuit) of the switchgear, and which penetrates the lower boot of the switchgear body in a manner such that the interface therebetween is continuously sealed via an inter-phase seal. As shown in FIG. 4, the inter-phase seal is produced (e.g., at 418) between finned silicone rubber connector 416, which may, for example, be integrally formed with the lower boot 408 of the switchgear body (e.g., using a vulcanizing process), and solid insulating barriers (e.g., 417) on the moving contact 411. This inter-phase seal is formed by intimate contact between the finned silicone rubber connector 416 and the solid insulating barriers 417 (e.g., through press-fit attachment) such that a seal may be maintained during actuation of the pushrod. The space or gap defined between the solid barriers 417 may be referred to as a channel. In some embodiments, to affect a continuous seal between the pushrod and the lower boot, the finned connector 416 and the solid insulating barriers 417 extend fully around the periphery of the pushrod (e.g., having a shape that mirrors the cross-sectional shape of the pushrod). Although the fins of finned silicone rubber connector 416 are shown in FIG. 4 in such a way that they appear to penetrate or otherwise physically overlap with the solid insulating barriers (e.g., 417) of the pushrod 411 that receives them, this is done to illustrate the interference fit (e.g., "press fit," or "friction fit") between the parts and is not meant to imply that the fins are required to encroach upon or pass through the solid insulating barriers (e.g., 417) in which they are received. In some embodiments, the inter-phase seal is positioned between a high voltage portion (as represented by arrows 400A of FIG. 4) of the switchgear and a "grounded" or zero-potential portion (as represented by arrows 400B of FIG. 4) of the switchgear. In some embodiments, the inter-phase seal is positioned between a higher voltage portion and a lower-potential portion of the switchgear. Further embodiments of the inter-phase seal element of the GREEN SWITCHGEAR may include finned connectors employing five or more, or four or fewer, fins, and/or fins composed of any other suitable flexible insulator material. Such insulator materials may comprise silicone rubber and/or other suitable materials having suitable insulating, elasticity, flexibility and/or other relevant material properties either in combination with, or as a substitute for, silicone rubber. Examples include ethylene propylene diene monomer (EPDM) rubber, natural rubber, viton, nitrile butadiene rubber (NBR), and/or the like. Schematic drawings of an exemplary lower boot 1012, including perspective and cross-sectional views, are shown in FIGS. 10A through 10F. A cross-sectional detail of finned connectors 1016 and 1026 comprising the inter-phase sealing mechanism according to some embodiments of the disclosure is shown in FIGS. 10F and 10G.

Figure 5A:
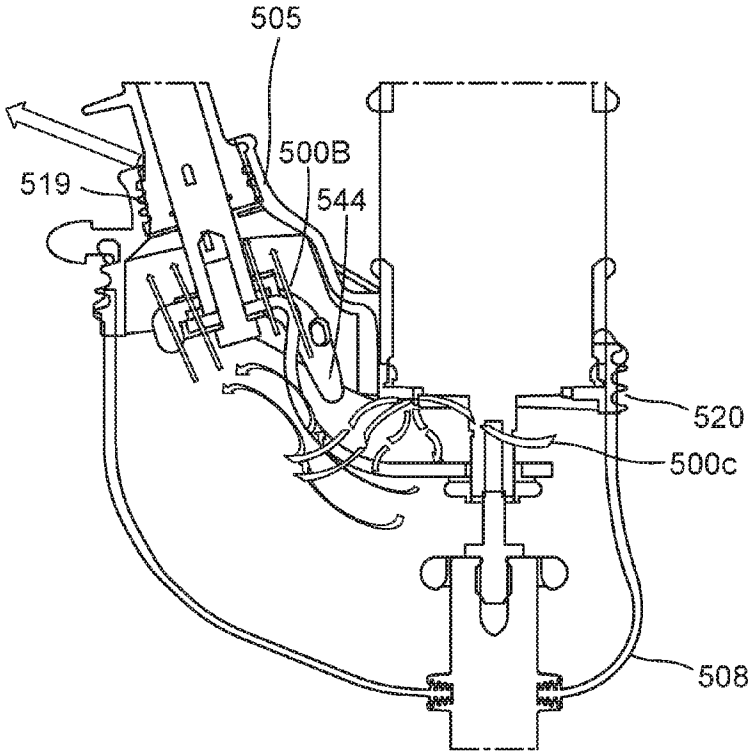
FIG. 5A is a cross-sectional partial view of a switchgear (with dark and light arrows to represent exemplary hot and cold air flows, respectively), according to some embodiments of the GREEN SWITCHGEAR.
Figure 5B:
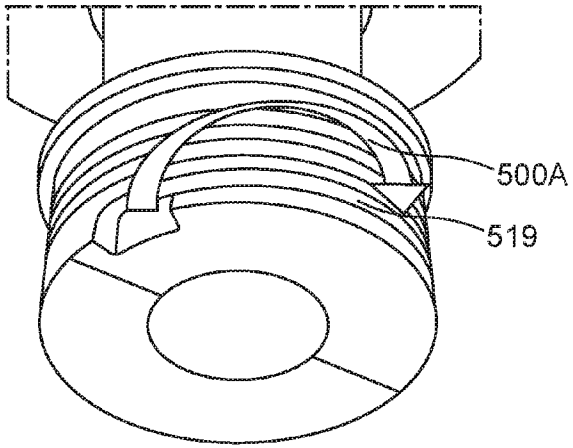
FIG. 5B is a detail three-dimensionally rendered perspective view of a lower portion of the bushing boot of FIG. 5A, according to some embodiments of the GREEN SWITCHGEAR.
Figure 5C:
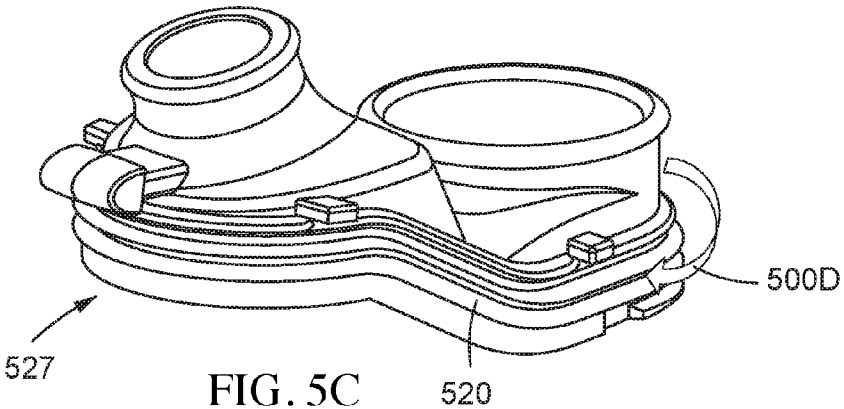
FIG. 5C is a three-dimensional rendering of the upper boot of FIG. 5A, according to some embodiments of the GREEN SWITCHGEAR.

As explained above, helical grooves (for example as shown in FIGS. 5A and 5B at 519, FIGS. 5A and 5C at 520, FIG. 6 at 621 and 622, or FIG. 7 at 722) are provided in some embodiments of the GREEN SWITCHGEAR, and may advantageously serve as creepage paths for purposes of voltage sealing. The helical grooves may also advantageously provide thermal management, for example by directing or permitting cold air (as represented by white arrows 500C in FIG. 5A) to enter the switchgear body via the upper boot portion of the switchgear body at (see 520 of FIGS. 5A and 722 of FIG. 7) and/or directing or permitting hot air (as represented by dark arrows 500B in FIG. 5A) to escape the switchgear body via the bushing boot at 519. By way of example, the direction of hot air travel in a helical groove is represented by arrow 500A, and the direction of cold air travel in a helical groove is represented by arrow 500D. In some embodiments, an interference fit (e.g., "press fit," or "friction fit") is made between the upper and lower boot, for example by stretching the upper boot and/or compressing the lower boot such that the upper boot accommodates a portion of the lower boot and securely attaches thereto once assembled. An interference fit may also be made between the bushing boot and the upper boot, and/or between the silicone rubber cover (e.g., FIG. 2 at 204) and at least one of the bushing and the vacuum interrupter, in some embodiments. Although the helical grooves depicted in the drawings (for example as shown in FIGS. 5A and 5B at 519, FIGS. 5A and 5C at 520, FIG. 6 at 621 and 622, or FIG. 7 at 722) may in some instances appear to penetrate or otherwise physically overlap with the boot or boot portion that receives it, it is to be understood that this is done to illustrate the interference fit between the parts and does not mean that the grooves (or any portion thereof) are required to encroach upon, penetrate, or pass through the boot (or other component or portion thereof) in which it is received.

Alternatively, in some embodiments, the upper boot 505 and the lower boot 508, as depicted in FIG. 5A, can be understood to illustrate an "overlay" arrangement, where the upper boot has not yet been connected with the lower boot, and thus the upper boot perimeter has not yet been compressed to fit within the receiving portion of the lower boot, and/or the lower boot has not yet been stretched to accommodate attachment of the upper boot. Also, while FIG. 2 shows an interference fit between the silicone rubber cover and the bushing/vacuum interrupter (by virtue of their overlapping outlines), the components are shifted to the side in FIG. 3 so that the silicone rubber just touches the bushing and the vacuum interrupter, for illustrative purposes (e.g., to make the grooves more easily visible). It is to be understood that alternate configurations, for example, where the lower boot is stretched and/or the upper boot is compressed, or where the boots have a different spatial relationship with one another (e.g., "left" and "right" instead of "upper" and "lower"), are also within the scope of this disclosure.

Figure 6:
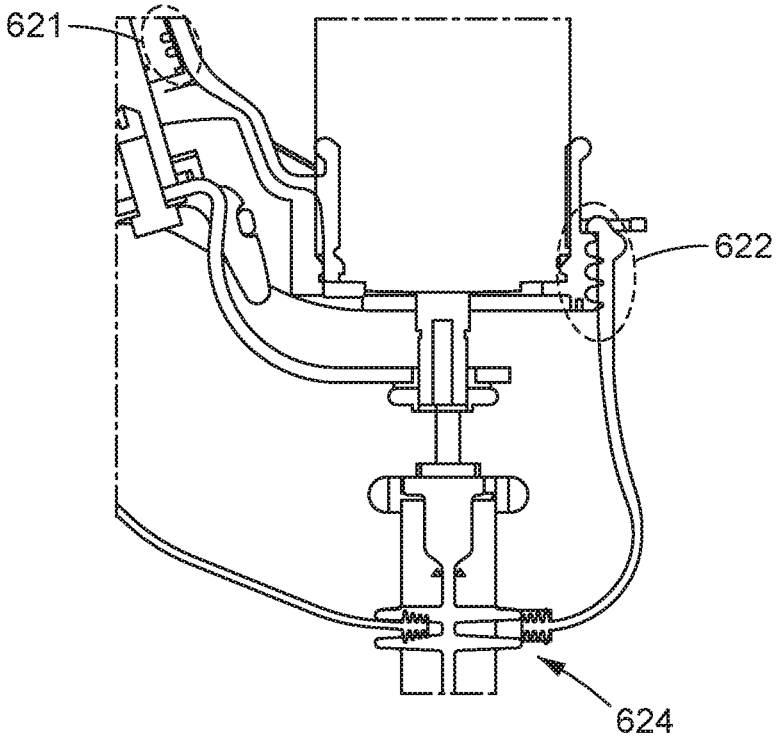
FIG. 6 is a cross-sectional partial view of a switchgear according to an embodiment of the GREEN SWITCHGEAR, indicating regions of helical grooves, and with one inter-phase seal not made, for example illustrating the assembled position of joint 622.
Figure 7:
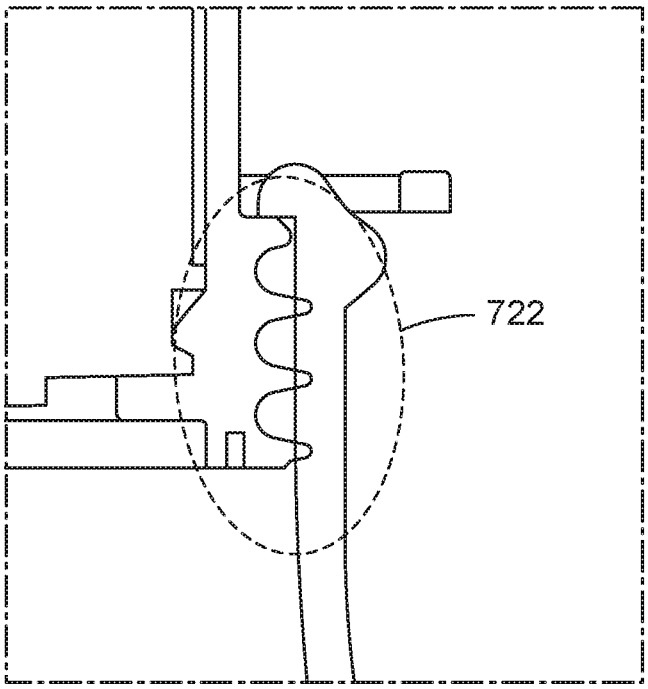
FIG. 7 is a cross-sectional partial view of an embodiment of the GREEN SWITCHGEAR, indicating a region of helical grooves.
Figure 8:
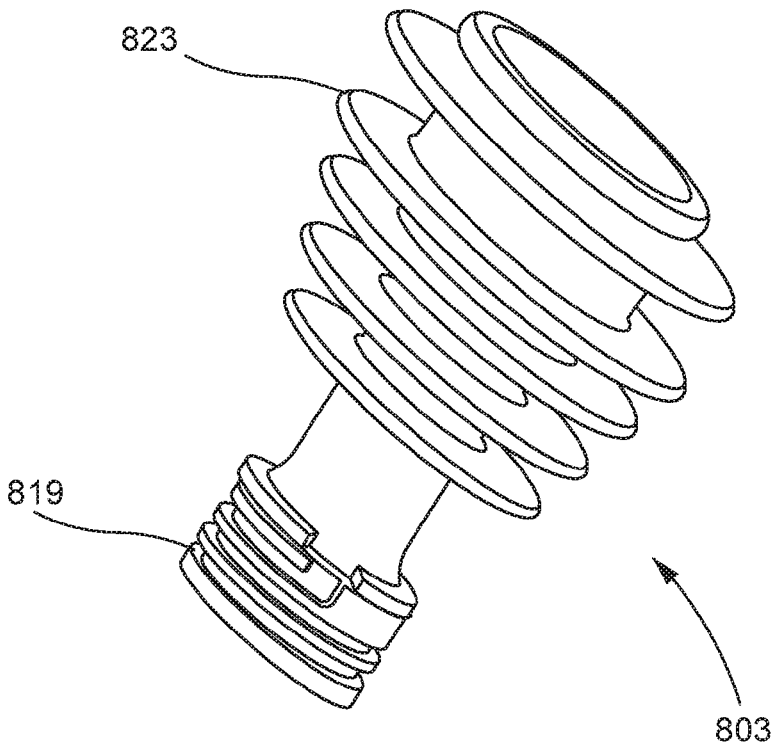
FIG. 8 is a three-dimensional rendering of a bushing boot according to some embodiments of the GREEN SWITCHGEAR.
Figure 9A:
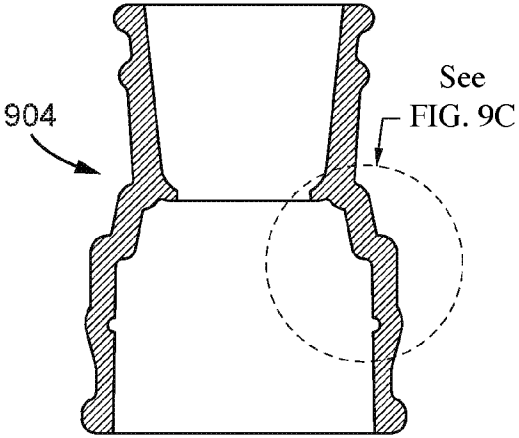
FIG. 9A is a schematic cross-sectional side view of a bushing boot according to some embodiments of the GREEN SWITCHGEAR.
Figure 9B:
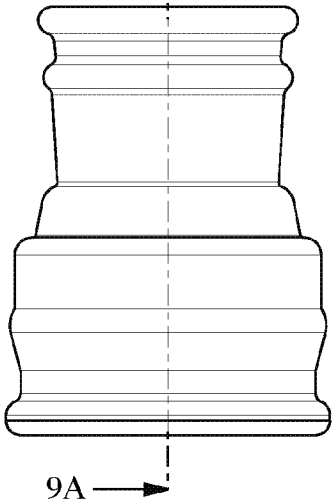
FIG. 9B is a schematic drawing of a side view of the bushing boot of FIG. 9A.
Figure 9C:
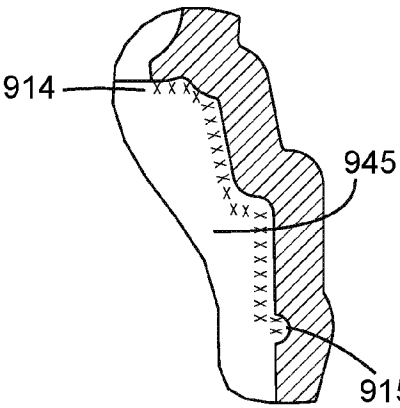
FIG. 9C is a cross-sectional detail view of a portion of the bushing boot of FIG. 9A, depicting a region of conductive paint applied to an inner surface thereof.
Figure 9D:
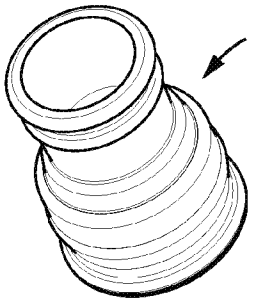
FIG. 9D is a schematic perspective view of the bushing boot of FIG. 9A.
Figure 9E:
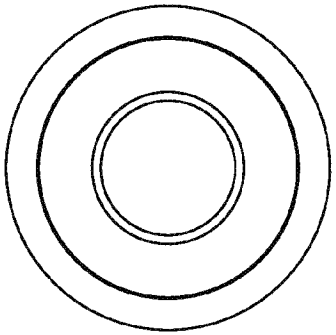
FIG. 9E is a top view of the bushing boot of FIG. 9A.

FIG. 6 provides a detailed cross-sectional view of the helically-grooved regions of the bushing boot and the upper boot of an embodiment of the GREEN SWITCHGEAR, at 621 and 622, respectively, in a "joined" or "joint" configuration, and with one of the inter-phase seals (at the location indicated by arrow 624) not yet made. Although the finned silicone rubber connector depicted in the drawings (for example as shown in FIG. 4 at 416, or in the lower left-hand portion of FIG. 6) may in some instances appear to partially penetrate or otherwise physically overlap with the pushrod that receives it, this is done merely to illustrate the interference fit between the parts and does not imply that the fins (or any portion thereof) are required to encroach upon or pass through the pushrod (or other component or portion thereof) in which they are received. For example, while FIG. 4 (at 418) and the left lower portion of FIG. 6 show an interference fit between the finned silicone rubber connector and the walls of the pushrod channel (by virtue of their overlapping outlines), the connector is shifted to the side (e.g., in a "disconnected" or "not yet connected" configuration) in the right lower portion of FIG. 6 for illustrative purposes (e.g., to make the fins more easily visible).

Figure 12B:
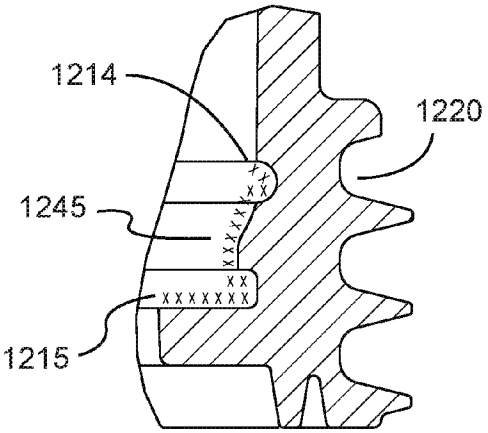
FIG. 12B is a cross-sectional detail view of a portion of the upper boot of FIG. 12A and depicting a region of conductive paint applied to an inner surface thereof.
Figure 12D:
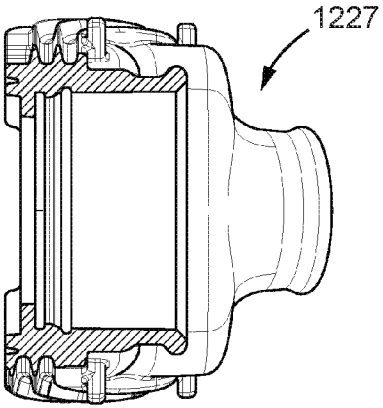
FIG. 12D is a rear view of the upper boot of FIG. 12A.

A detail partial view of the upper boot helical groove is found at 1220 of FIG. 12B, along with a cross-sectional detail of conductive paint 1245 applied to the interior surface of said upper boot (with the paint extending from paint termination 1214 to paint termination 1215), as used by some embodiments of the GREEN SWITCHGEAR. Notably, the cross-sectional profile of the paint reveals it to be at least somewhat conformal with the underlying bushing surface, and to have a curvilinear profile at paint termination 1214. Depending on the embodiment, the conductive paint applied to the surfaces of the GREEN SWITCHGEAR may be substantially conformal, moderately conformal, somewhat conformal, or non-conformal, or may have a low degree of conformality. As described previously, the conductivity of the paint, shape of the painted profile, and/or location of the painted area help to avoid partial discharge caused by trapped air at the mating surfaces on primary current carrying components. Additionally, the curved ends of the paint may aid, for example, in reducing unwanted partial electrical discharge caused by field concentration at sharp points and edges. In some embodiments, flashing (e.g., thin layer(s) of material protruding from a part along the parting line of the cavity of the mould during manufacturing) is strictly forbidden on all surfaces of the bushing boot.

Figure 12A:
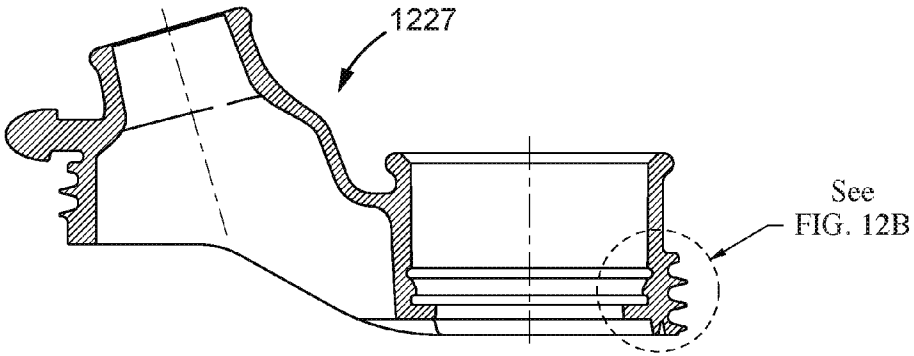
FIG. 12A is a cross-sectional view of an upper boot according to some embodiments of the GREEN SWITCHGEAR.
Figure 12C:
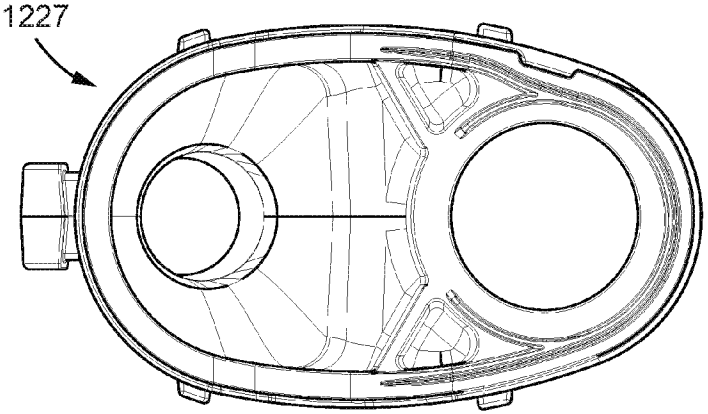
FIG. 12C is a top view of the upper boot of FIG. 12A.
Figure 13E:
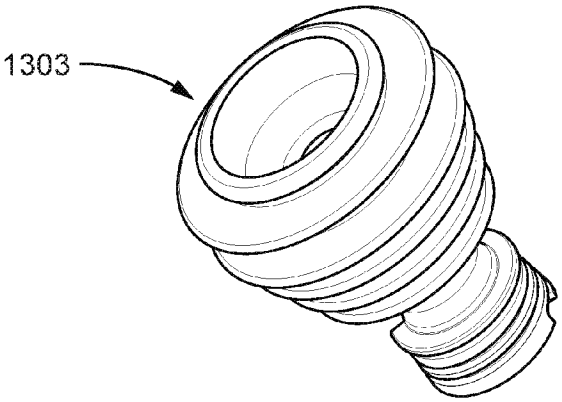
FIG. 13E is a perspective view of the bushing boot of FIG. 13A.
Figure 13D:
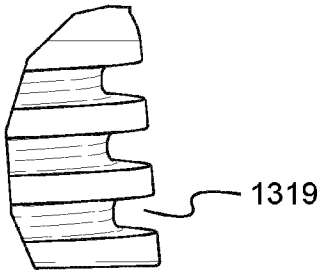
FIG. 13D is a detail side view of a portion of the bushing boot of FIG. 13A.
Figure 13C:
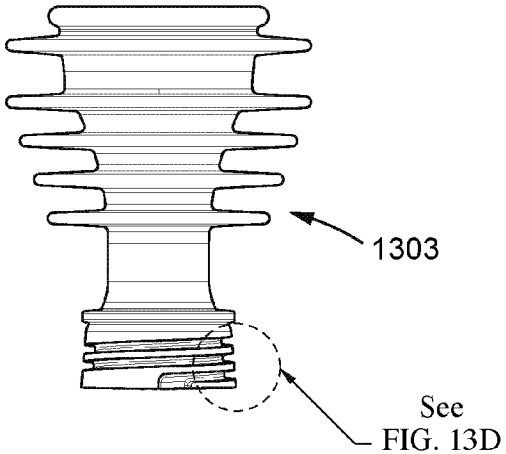
FIG. 13C is a side view of the bushing boot of FIG. 13A.
Figure 13A:
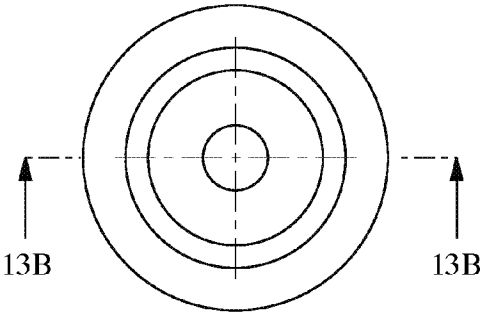
FIG. 13A is a top view of a bushing boot according to some embodiments of the GREEN SWITCHGEAR.
Figure 13B:
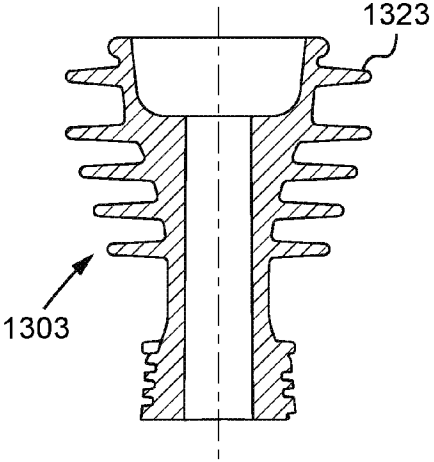
FIG. 13B is a cross-sectional side view of the bushing boot of FIG. 13A.
Figure 14A:
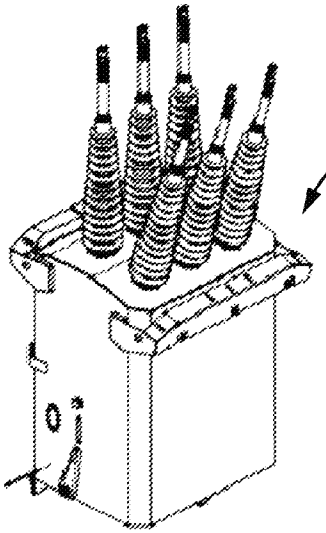
FIG. 14A is a perspective view of a switchgear according to an embodiment of the GREEN SWITCHGEAR.
Figure 14B:
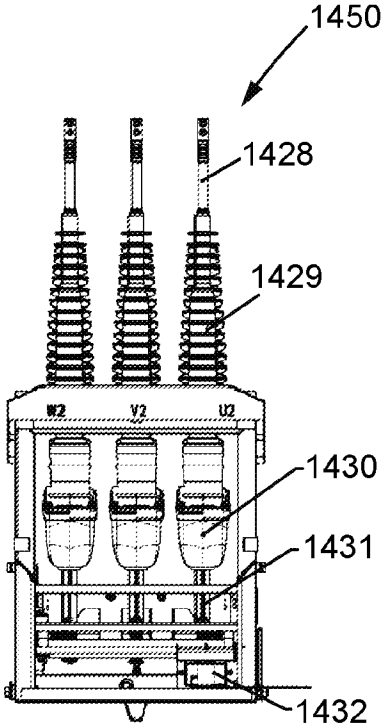
FIG. 14B is a cross-sectional rear view of the switchgear of FIG. 14A.
Figure 14C:
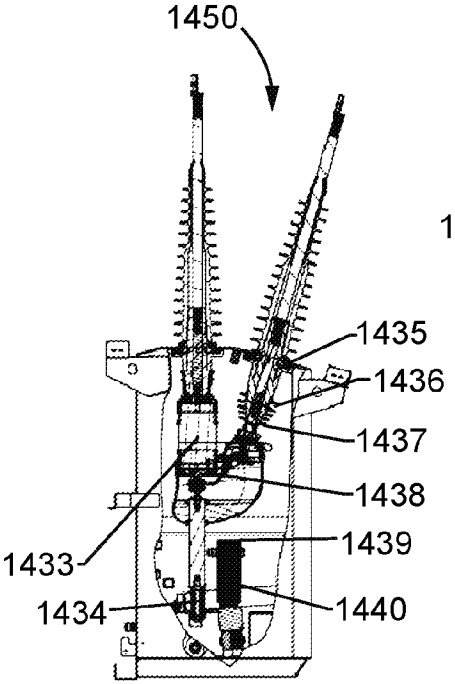
FIG. 14C is a cross-sectional left view of the switchgear of FIG. 14A.
Figure 14D:
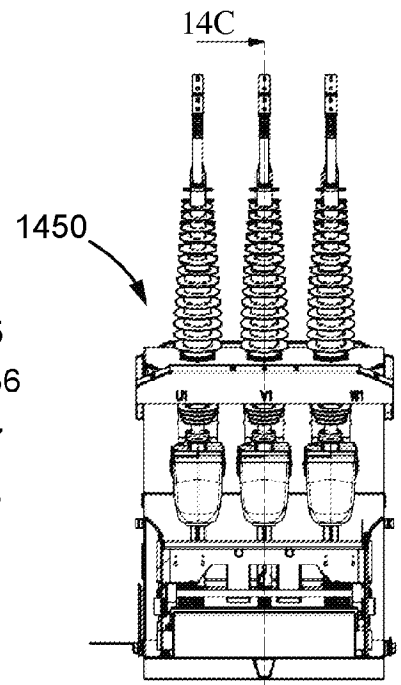
FIG. 14D is a cross-sectional front view of the switchgear of FIG. 14A.

Schematic drawings, including multiple perspective views, of an upper boot 1127 and 1227 according to some embodiments of the GREEN SWITCHGEAR, are provided in FIGS. 11A-11D and 12A-12D, respectively. FIG. 12A depicts a cross-sectional view of upper boot 1227, taken along the line A-A indicated in FIG. 12D. three-dimensional rendering of a bushing boot 803 according to an embodiment of the GREEN SWITCHGEAR, employing both a helical groove 819 as well as a series of heat removal fins 823 is shown in FIG. 8, and FIGS. 13A-13E are schematic drawings, including perspective, detail partial, and cross-sectional views, of a bushing boot 1303 according to some embodiments of the GREEN SWITCHGEAR. The heat removal fins (e.g., as also shown in FIG. 13B at 1323) may, in some embodiments, function as "heat sinks," for example to conduct and/or radiate heat generated in the switchgear as a result of current passing through the unit (e.g., the heat forming a hot air cushion around the current carrying path). A partial detail view of helical groove 1319 is shown in FIG. 13D. The silicone rubber according to some embodiments of the GREEN SWITCHGEAR may include an additive, such as iron-oxide, for example to improve the thermal conductivity without compromising its insulating properties. In some embodiments, flashing (e.g., the thin layer(s) of material protruding from a part along the parting line of the cavity of the mould during manufacturing) is strictly forbidden on all surfaces of the upper boot).

An example bushing boot 904 of the GREEN SWITCHGEAR is schematically shown in FIGS. 9A through 9E, via multiple perspective and cross-sectional views, as well as a cross-sectional detail of conductive paint 945 applied to the inner surface of said bushing boot 904, as according to some embodiments of the GREEN SWITCHGEAR. Notably, the cross-sectional profile of the paint reveals it to be at least moderately conformal with the underlying bushing surface, and to have a curvilinear profile at paint terminations 914 and 915. As described previously, the conductivity of the paint, shape of the painted profile, and/or location of the painted area help to avoid partial discharge caused by trapped air at the mating surfaces on primary current carrying components. Additionally, curvature at the ends of the painted region (e.g., by virtue of the shape of the paint layer itself, the shape of the paint in combination with an underlying surface, and/or the degree of conformality of a coating applied to the inner surface of the bushing boot 904) can be configured to, for example, reduce unwanted partial electrical discharge caused by field concentration at sharp points and edges. In some embodiments, flashing (e.g., the thin layer(s) of material protruding from a part along the parting line of the cavity of the mould during manufacturing) is strictly forbidden on all surfaces of the bushing boot.

Figure 15B:
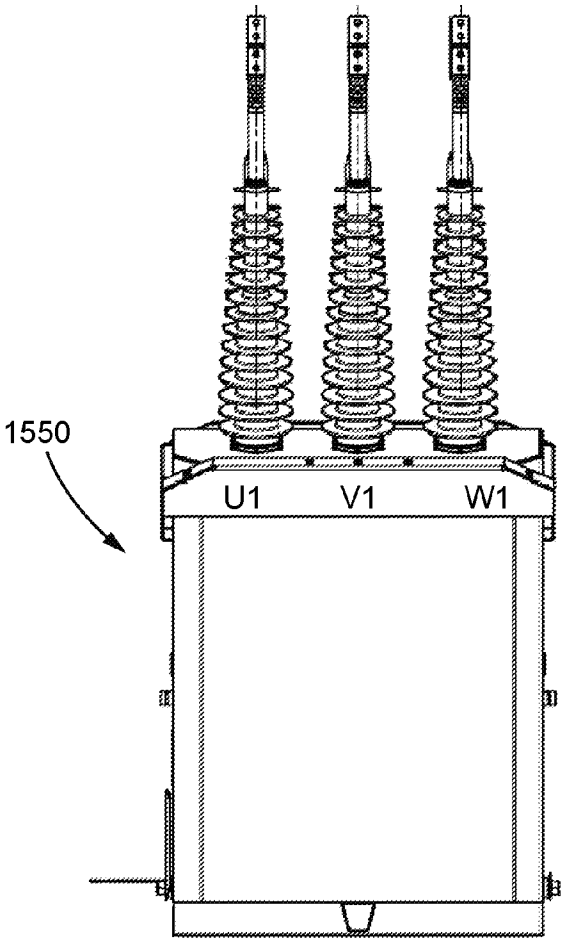
FIG. 15B is a front view of the switchgear of FIG. 15A.
Figure 15A:
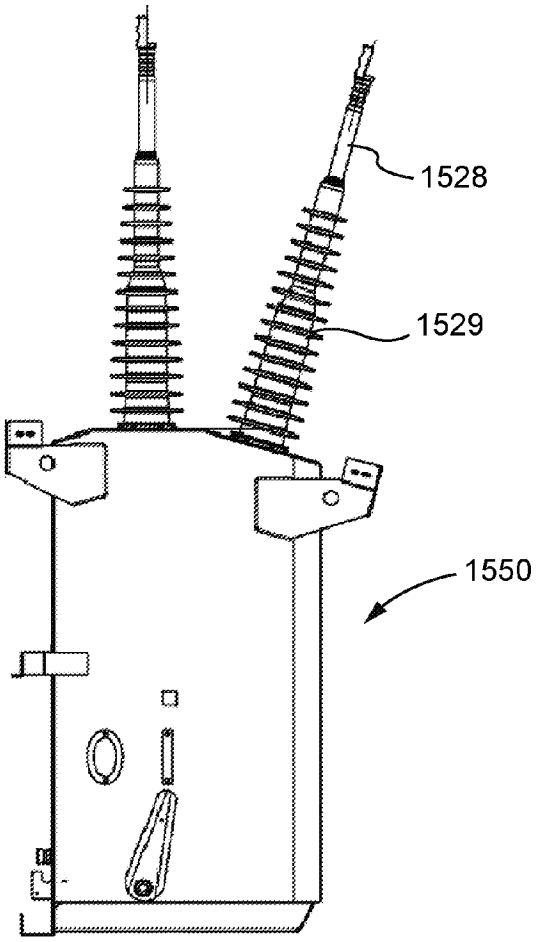
FIG. 15A is a left view of a switchgear according to an embodiment of the GREEN SWITCHGEAR.
Figure 16A:
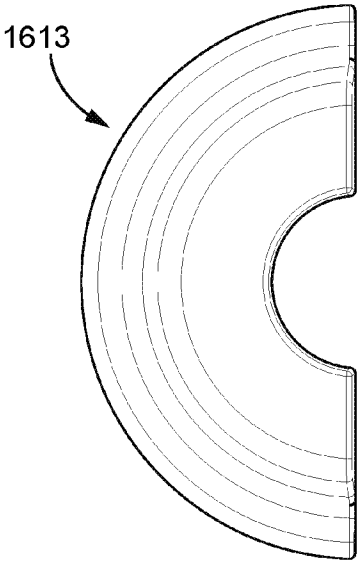
FIG. 16A is a partial top view of a spacer according to some embodiments of the GREEN SWITCHGEAR.
Figure 16B:
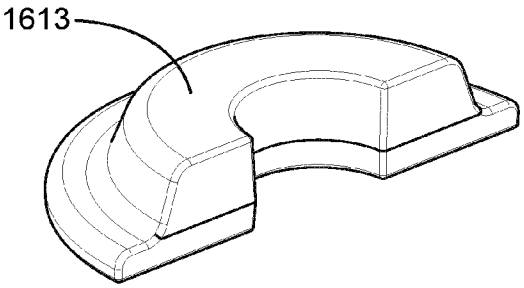
FIG. 16B is a perspective partial view of the spacer of FIG. 16A.
Figure 16C:
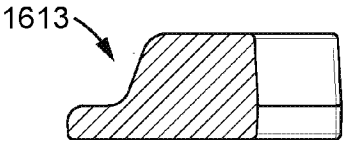
FIG. 16C is a partial radial cross-section view of the spacer of FIG. 16A.
Figure 16D:
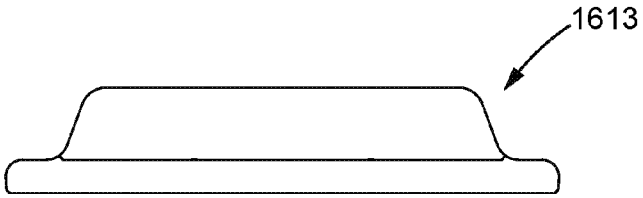
FIG. 16D is a side view of the spacer of FIG. 16A.

Once fabricated, embodiments of the GREEN SWITCHGEAR can be arrayed, co-located, grouped, interconnected, commonly housed, etc. as variously depicted in FIGS. 14A through 14D and FIGS. 15A-15B. As shown in FIGS. 14A through 14D (with housing panels removed so that internal components are visible), an example of an assembled switchgear apparatus (collectively as 1450) include high voltage cable 1428, bushing boot 38 kV 1429, silicone rubber insulation (e.g., at 1430, 1436), moulded pushrod 1431, trip solenoid assembly 1432, contact spring 1434, vacuum interrupter 1433, bushing 1435, extension conductor 1437, flexible conductor 1438, close solenoid assembly 1439, and plate return spring 1440. GREEN SWITCHGEAR technology can be applied in applications such as reclosers, sectionalisers, load break switches, gas insulated switchgears (GIS), solid insulation switchgears (SIS), ring main units (RMU), switchfuse/fuseswitch combinations, busducts, vacuum circuit breakers (VCB) and/or in any type of switchgear panel. In some embodiments, close solenoid assembly 1439 is a recloser, and functions as a circuit breaker to selectively "open" and "close" one or more circuits internal to the switchgear Similarly, FIGS. 15A-15B depict assembled switchgear apparatus (collectively as 1550) with outer panels in place such that the internal components are not visible. Visible components in FIGS. 15A-15B include high voltage cable 1528 and bushing boot 38 kV 1529.

Figure 17A:
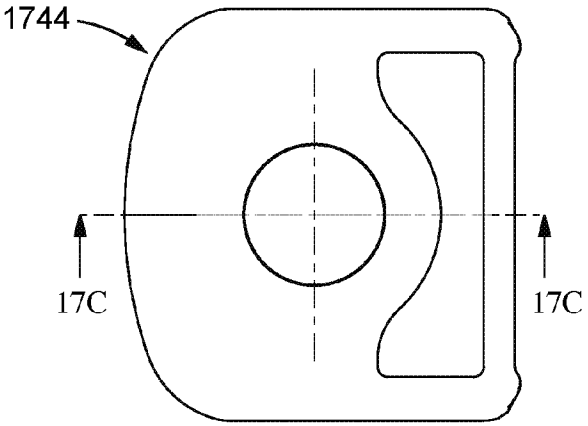
FIG. 17A is a top view of a flexible guide according to some embodiments of the GREEN SWITCHGEAR.
Figure 17B:
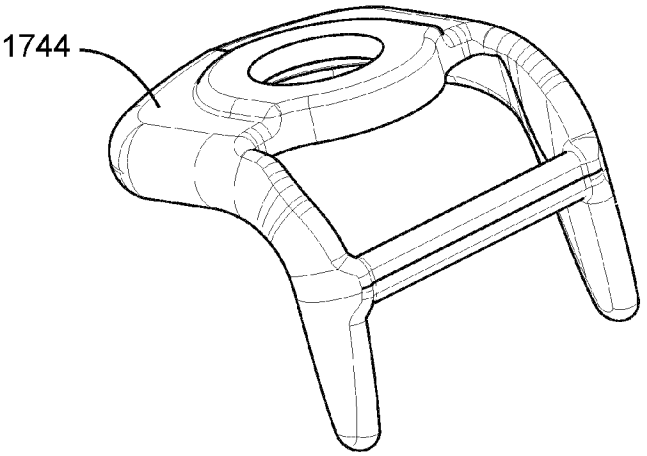
FIG. 17B is a perspective view of the flexible guide of FIG. 17A.
Figure 17C:
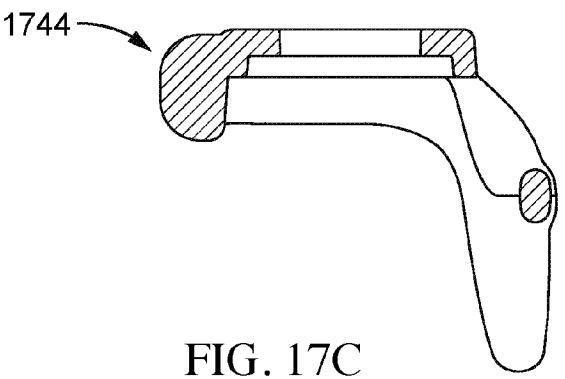
FIG. 17C is a cross-sectional view of the flexible guide of FIG. 17A.
Figure 17D:
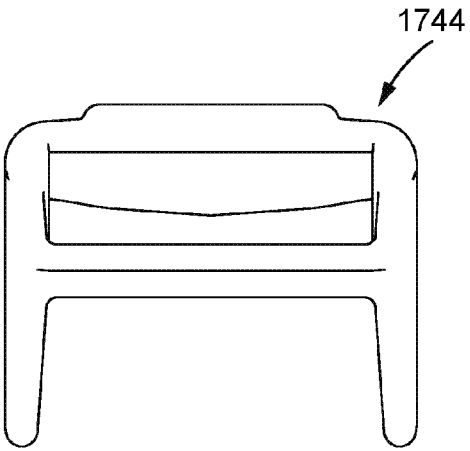
FIG. 17D is a rear view of the flexible guide of FIG. 17A.

FIGS. 16A through 16D include multiple schematic views of an exemplary aluminum spacer 1613 according to some embodiments of the GREEN SWITCHGEAR. As can be seen, for example, in FIG. 3 at 313, a spacer may be positioned between the vacuum interrupter and the primary bushing. In some embodiments, a spacer having a composition different from or in addition to aluminum. For example, in some implementations, the spacer comprises a relatively lightweight conductor material including, but not limited to, titanium, carbon, an aluminum alloy, a metal composite such as copper/aluminum, an electroceramic material, a carbon-nanotube impregnated material, a nanomaterial-impregnated material, a conductive polymer material, various combinations thereof, and/or the like. FIGS. 17A through 17D include multiple schematic views of an exemplary flexible guide 1744 according to some embodiments of the GREEN SWITCHGEAR, for example as can be seen in an assembled position in FIG. 1 at 144 or in FIG. 5A at 544. FIG. 17C depicts a cross-sectional view of flexible guide 1744, taken along line A-A indicated in FIG. 17A.

Figure 18B:
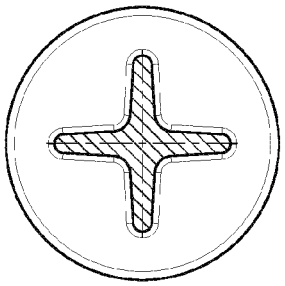
FIG. 18B is an end view of the pushrod of FIG. 18A.
Figure 18A:
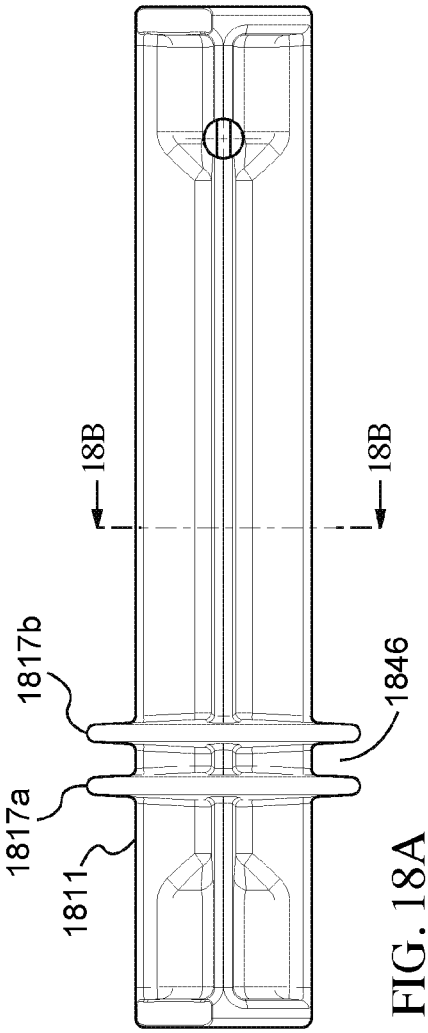
FIG. 18A is a side view of a pushrod according to some embodiments of the GREEN SWITCHGEAR.
Figure 18C:
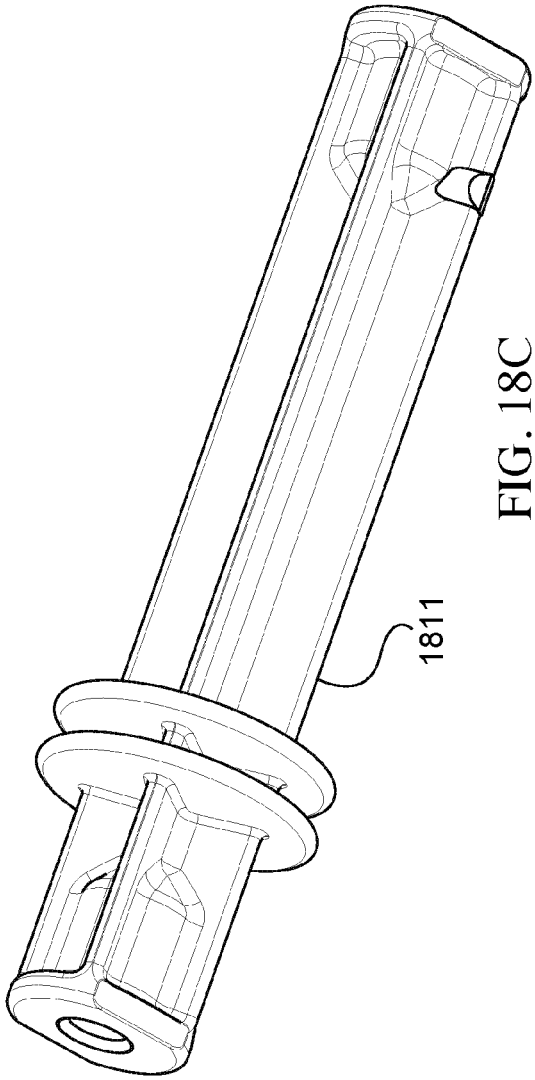
FIG. 18C is a perspective view of the pushrod of FIG. 18A.

FIGS. 18A through 18C depict multiple schematic views of an exemplary pushrod 1811 according to some embodiments of the GREEN SWITCHGEAR, for example as can be seen in FIG. 1 at 111 or FIG. 4 at 411. As previously discussed, solid insulating barriers (e.g., as shown at 1817*a* and 1817*b*) on the pushrod may form a channel 1846, for example to receive a finned silicone connector of a lower boot as hereinbefore described.

According to some embodiments of the disclosure, a switchgear apparatus includes a switchgear body housing having an upper boot and a lower boot (one or both of which comprise an insulating material), a vacuum interrupter with at least one stationary electrical contact and an insulating moveable contactor coupled to a moveable electrical contact, and two or more bushings having conductor material passing there through. In some implementations, the upper boot and the lower boot comprise an insulating material. Further implementations include one or more of the following: a bushing boot having at least one of a helical groove and/or an array of heat-removal fins; a flexible insulating cover enclosing at least a portion of the vacuum interrupter and an adjacent bushing; a helical groove in the upper boot; and/or a finned connector constrained within a channel in the pushrod. Embodiments can be configured to be free from (or essentially free from or substantially free from) harmful, toxic and/or dangerous gases, including environmental pollutants, such as greenhouse gases, and in some implementations, may be free, essentially free, or substantially free from sulphur hexafluoride.

According to some embodiments of the disclosure, a switchgear apparatus comprises a body housing having at least two insulating bushings, each bushing configured as at least one of a conduit and/or a support for an electrical conductor. The apparatus also comprises a vacuum interrupter coupled (directly or indirectly, depending on the implementation) to each of the at least two insulating bushings, the vacuum interrupter including one or more stationary electrical contacts and one or more moveable electrical contacts configured to selectively open and close an electrical circuit via one or more flexible conductor elements and/or one or more slidable electrical contacts. The apparatus also includes a pushrod (or like mechanism) coupled to at least one moveable electrical contact. Some embodiments may include a plurality of components forming a conductive path extending through the apparatus, wherein of the plurality of components are at least one of sealed, insulated and/or covered by a flexible insulating material and/or a rigid insulating material. In further embodiments, at least one of the insulating material, the bushing boot, and/or the insulating cover comprises a flexible dielectric material (which may be, by way of non-limiting example, silicone rubber, ethylene propylene diene monomer (EPDM) rubber, and/or the like. In some embodiments, the insulating material comprises a conductive coating on at least a portion of its inner surface and/or a conductive material embedded therein.

Some embodiments of the disclosure provide for a green switchgear apparatus that comprises: a switchgear body housing comprising an upper boot and a lower boot, the upper boot and the lower boot including an insulating material; a vacuum interrupter coupled at a first end to the upper boot and including an at least one stationary electrical contact and an at least one moveable electrical contact; at least one flexible conductor element housed within the switchgear body housing; a pushrod coupled to the at least one moveable electrical contact; at least one bushing boot coupled to the upper boot and having conductor material passing therethrough; at least one bushing coupled to the bushing boot; and at least one further bushing coupled to the vacuum interrupter at a second end of the vacuum interrupter and forming an interface therebetween, the interface surrounded by an insulating cover. In some such embodiments, the pushrod penetrates a wall of the lower boot, with the interface between the pushrod and the lower boot being sealed by cooperation between a perimeter groove of the pushrod and a complementary finned connector of the lower boot.

In some embodiments, a green switchgear apparatus according to the disclosure comprises: a switchgear body housing with an upper boot and a lower boot, the upper boot and the lower boot including an insulating material; a vacuum interrupter coupled at a first end to the upper boot and including an at least one stationary electrical contact and an at least one moveable electrical contact; at least one flexible conductor element housed within the switchgear body housing; a pushrod coupled to the at least one moveable electrical contact; at least one bushing coupled to the upper boot and having conductor material passing therethrough; at least one further bushing received by an insulating bushing boot, the bushing boot being coupled to the upper boot; and at least one bushing connected to the vacuum interrupter at a second end of the vacuum interrupter and forming an interface, the interface surrounded by an insulating cover. In some such embodiments, at least one of the upper boot and the lower boot comprises a perimeter groove configured to provide sufficient creepage distance such that at least one of flashover and/or voltage breakdown in the switchgear apparatus is prevented when in an energized condition. In some embodiments, the bushing boot comprises a perimeter helical groove, the helical groove configured to provide sufficient creepage distance to prevent at least one of flashover and voltage breakdown in the switchgear apparatus when in an energized condition. In some additional or alternative embodiments, the bushing boot comprises a plurality of heat removal fins, the fins configured to promote at least one of conduction and radiation of heat generated by the apparatus when in an energized condition. In some such implementations, the fins comprise an additive having thermal conductivity exceeding the thermal conductivity of a base material of the fins, the additive configured to promote heat transfer when in use. In some embodiments, at least one of the insulating material, the bushing boot, and/or the insulating cover comprises a flexible dielectric material, such as silicone rubber, EPDM rubber, and/or the like, either alone or in combination with another material, depending on the embodiment.

To address various issues and advance the art, the entirety of this application for GREEN SWITCHGEAR APPARATUSES, METHODS AND SYSTEMS (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed innovations may be practiced. The advantages and features of the application are of a representative sample of embodiments only, and are not exhaustive and/or exclusive. They are presented only to assist in understanding and teach the invention. It should be understood that they are not representative of all claimed innovations. As such, certain aspects of the disclosure have not been discussed herein. That alternate embodiments may not have been presented for a specific portion of the innovations or that further undescribed alternate embodiments may be available for a portion is not to be considered a disclaimer of those alternate embodiments. It is to be understood that other embodiments may be utilized, and that functional, logical, operational, organizational, structural and/or topological modifications can be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any components and/or any present feature sets as described in the figures and/or throughout are not limited to a fixed order and/or arrangement, but rather, any disclosed order is exemplary and all equivalents, regardless of order and/or arrangement, are contemplated by the disclosure. Furthermore, some of these embodiments can, where feasible, be combined to form additional embodiments, while other features may be mutually contradictory, in that they cannot be simultaneously present in a single embodiment. Similarly, some features are applicable to one aspect of the innovations, and inapplicable to others. In addition, the disclosure includes other innovations not presently claimed. Applicant reserves all rights in those presently unclaimed innovations including the right to claim such innovations, file additional applications, continuations, continuations in part, divisions, and/or the like thereof. As such, it should be understood that advantages, embodiments, examples, features, and functional, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a GREEN SWITCHGEAR individual user and/or enterprise user, various embodiments of the GREEN SWITCHGEAR may be implemented that enable a great deal of flexibility and customization. For example, aspects of the GREEN SWITCHGEAR can be scaled or otherwise adapted for any type of electrical power delivery project. While various embodiments and discussions of the GREEN SWITCHGEAR have been disclosed herein, it is to be understood that these embodiments may be readily configured and/or customized for a wide variety of other applications and/or implementations.

What is claimed is:

1. A switchgear apparatus comprising:

a switchgear body housing having an upper boot and a lower boot, the upper boot having an insulating material and the lower boot having an insulating material;

a vacuum interrupter having at least one stationary electrical contact and an insulating moveable contactor coupled to a moveable electrical contact; and at least two bushings having conductor material passing therethrough, the apparatus further comprising at least one of the following:

a bushing boot, separate from the upper boot and the lower boot, having at least one of a helical groove and/or an array of heat-removal fins;

a flexible insulating cover enclosing at least a portion of the vacuum interrupter and an adjacent bushing;

a helical groove in the upper boot; and a finned connector constrained within a channel in the moveable contactor.

2. The apparatus of claim 1, wherein the apparatus does not contain sulphur hexafluoride.

3. The apparatus according to claim 1, further comprising a plurality of components forming a conductive path extending through the apparatus, the plurality of components being at least one of sealed, insulated and/or covered by a flexible insulating material or a rigid insulating material.

4. The apparatus according to claim 3, wherein at least one of the insulating material, the bushing boot, or the insulating cover includes a flexible dielectric material.

5. The apparatus according to claim 4, wherein the flexible dielectric material comprises silicone rubber.

6. The apparatus according to claim 4, wherein the flexible dielectric material comprises ethylene propylene diene monomer (EPDM) rubber.

7. The apparatus according to claim 3, wherein the insulating material includes a conductive coating on at least a portion of its inner surface and/or a conductive material embedded therein.

8. A switchgear apparatus comprising:

a switchgear body housing having an upper boot and a lower boot, the upper boot and the lower boot each including an insulating material;

a vacuum interrupter coupled at a first end to the upper boot and including an at least one stationary electrical contact and an at least one moveable electrical contact;

at least one flexible conductor element housed within the switchgear body housing;

a pushrod coupled to the at least one moveable electrical contact;

at least one bushing boot, separate from the upper boot and the lower boot, and having conductor material passing through the at least one bushing boot;

a first bushing coupled to the bushing boot; and a second bushing coupled to a second end of the vacuum interrupter and forming an interface therebetween, the interface surrounded by an insulating cover.

9. The apparatus according to claim 8, wherein the pushrod penetrates a wall of the lower boot, the interface between the pushrod and the lower boot being sealed by cooperation between a perimeter groove of the pushrod and a complementary finned connector of the lower boot.

10. A switchgear apparatus comprising:

a switchgear body housing comprising an upper boot and a lower boot, the upper boot and the lower boot each including an insulating material;

a vacuum interrupter coupled at a first end to the upper boot and including an at least one stationary electrical contact and an at least one moveable electrical contact;

at least one flexible conductor element housed within the switchgear body housing;

a pushrod coupled to the at least one moveable electrical contact;

a first bushing coupled to the upper boot and having conductor material passing therethrough;

a second bushing received by an insulating bushing boot that is separate from the upper boot and the lower boot; and at least one bushing connected to a second end of the vacuum interrupter and forming an interface, the interface surrounded by an insulating cover.

11. The apparatus according to claim 10, wherein at least one of the upper boot or the lower boot defines a perimeter groove, the perimeter groove defining a creepage distance sufficient to prevent at least one of flashover or voltage breakdown in the switchgear apparatus when in an energized condition.

12. The apparatus according to claim 10, wherein the bushing boot defines a perimeter groove, the groove defining a creepage distance sufficient to prevent at least one of flashover or voltage breakdown in the switchgear apparatus when in an energized condition.

13. The apparatus according to claim 10, wherein the bushing boot includes a plurality of heat removal fins configured to promote at least one of conduction or radiation of heat generated by the apparatus when in an energized condition.

14. The apparatus according to claim 13, wherein the plurality of heat removal fins includes an additive whose thermal conductivity exceeds a thermal conductivity of a base material of the plurality of heat removal fins, the additive configured to promote heat transfer.

15. The apparatus according to claim 10, wherein at least one of the insulating material, the bushing boot, or the insulating cover includes a flexible dielectric material.

16. The apparatus according to claim 15, wherein the flexible dielectric material comprises silicone rubber.

17. The apparatus according to claim 15, wherein the flexible dielectric material comprises ethylene propylene diene monomer (EPDM) rubber.

18. The apparatus according to claim 1, wherein the bushing boot defines a perimeter groove, the perimeter groove defining a creepage distance sufficient to prevent at least one of flashover or voltage breakdown in the switchgear apparatus when in an energized condition.

* * * * *